US005755397A

United States Patent [19]

Freese

[11] Patent Number: 5,755,397

[45] Date of Patent: May 26, 1998

[54] BRAKING DEVICE FOR TOILET TISSUE DISPENSER

[76] Inventor: Andrew S. Freese, 316 Berry St., Louisa, Ky. 41230

[21] Appl. No.: 762,277

[22] Filed: Dec. 9, 1996

[51] Int. Cl.[6] ..... B65H 16/06

[52] U.S. Cl. ..... 242/599.1; 242/599.2; 242/423.1

[58] Field of Search ..... 242/423.1, 599.1, 242/599.2

[56] References Cited

U.S. PATENT DOCUMENTS

| | | | |
|---|---|---|---|
| 631,402 | 8/1899 | Lewis | 242/423.1 |
| 2,179,334 | 11/1939 | Keyes | 242/423.1 X |
| 2,905,404 | 9/1959 | Simmons | 242/423.2 |
| 3,941,320 | 3/1976 | Strunk | 242/423.1 X |
| 4,360,172 | 11/1982 | Cope | 242/423.1 X |
| 4,714,211 | 12/1987 | Hwang | 242/423.1 |
| 4,883,234 | 11/1989 | Yamakawa et al. | 242/423.1 |
| 4,915,319 | 4/1990 | Gerber | 242/423.1 |
| 4,919,350 | 4/1990 | Miller | 242/423 |
| 5,337,972 | 8/1994 | Bhagwat et al. | 242/423.1 X |
| 5,564,645 | 10/1996 | Lissoni | 242/423.1 |

FOREIGN PATENT DOCUMENTS

| | | | |
|---|---|---|---|
| 1094948 | 5/1955 | France | 242/599.2 |
| 41630 | 9/1937 | Netherlands | 242/599.2 |

*Primary Examiner*—Donald P. Walsh
*Assistant Examiner*—Emmanuel M. Marcelo

[57] ABSTRACT

A new apparatus for saving toilet tissue for reducing the amount of tissue used. The inventive device includes a spring biased ring member mounted around the spindle and between the end of the roll and one of the support arms for producing a pressure on the end of the roll and reducing the ease with which it can rotate about the spindle and dispense tissue.

3 Claims, 3 Drawing Sheets

FIG. 5
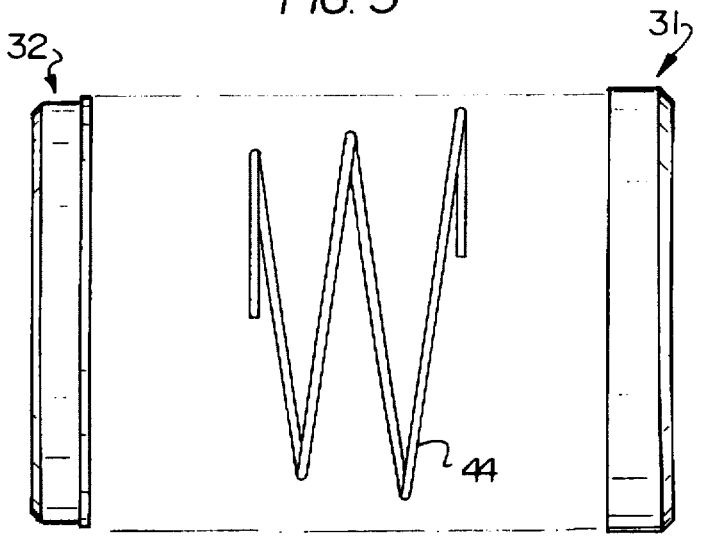
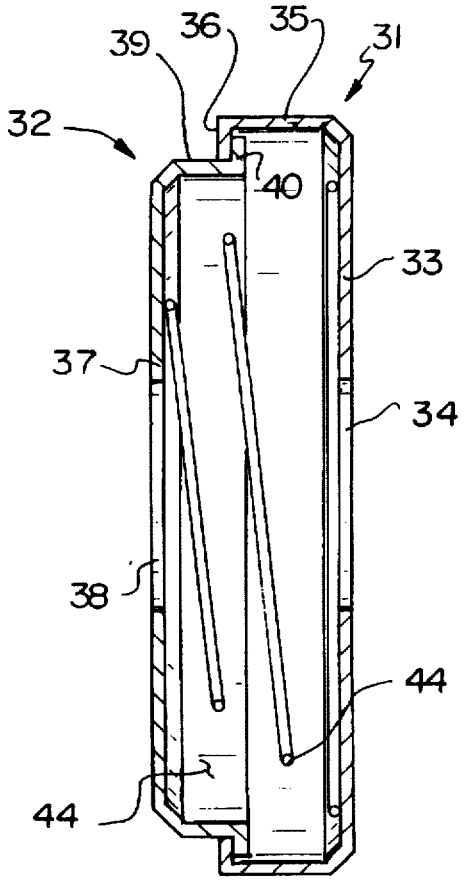
FIG.6

BRAKING DEVICE FOR TOILET TISSUE DISPENSER

BACKGROUND OF THE INVENTION

1. Field of the Invention

The present invention relates to toilet tissue dispensers and more particularly pertains to a new braking device for toilets tissue dispenser for reducing the amount of tissue used.

2. Description of the Prior Art

The use of toilet tissue dispensers is known in the prior art. More specifically, toilet tissue dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet tissue dispensers include U.S. Pat. No. 4,721,264; U.S. Pat. No. 4,042,159; U.S. Pat. Des. No. 292,155; U.S. Pat. No. 4,659,028; U.S. Pat. Des. No. 348,579 and U.S. Pat. No. 4,830,301.

While these devices fulfill their respective, particular objectives and requirements, the aforementioned patents do not disclose a new braking device for toilet tissue dispenser. The inventive device includes a spring biased ring member mounted around the spindle and between the end of the roll and one of the support arms for producing a pressure on the end of the roll and reducing the ease with which it can dispense tissue.

In these respects, the braking device for toilet tissue dispenser according to the present invention substantially departs from the conventional concepts and designs of the prior art, and in so doing provides an apparatus primarily developed for the purpose of reducing the amount of tissue used.

SUMMARY OF THE INVENTION

In view of the foregoing disadvantages inherent in the known types of toilet tissue dispensers now present in the prior art, the present invention provides a new braking device for toilet tissue dispenser construction wherein the same can be utilized for reducing the amount of tissue used.

The general purpose of the present invention, which will be described subsequently in greater detail, is to provide a new braking device for toilet tissue dispenser apparatus and method which has many of the advantages of the toilet tissue dispensers mentioned heretofore and many novel features that result in a new braking device for toilet tissue dispenser which is not anticipated, rendered obvious, suggested, or even implied by any of the prior art toilet tissue dispensers, either alone or in any combination thereof.

To attain this, the present invention generally comprises a spring biased ring member mounted around the spindle and between the end of the roll and one of the support arms for producing a pressure on the end of the roll and reducing the ease with which it can dispense tissue.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new braking device for toilet tissues dispenser apparatus and method which has many of the advantages of the toilet tissue dispensers mentioned heretofore and many novel features that result in a new braking device for toilet tissue dispenser which is not anticipated, rendered obvious, suggested, or even implied by any of the prior art toilet tissue dispensers, either alone or in any combination thereof.

It is another object of the present invention to provide a new braking device for toilet tissue dispenser which may be easily and efficiently manufactured and marketed.

It is a further object of the present invention to provide a new braking device for toilet tissue dispenser which is of a durable and reliable construction.

An even further object of the present invention is to provide a new braking device for toilet tissue dispenser which is susceptible of a low cost of manufacture with regard to both materials and labor, and which accordingly is then susceptible of low prices of sale to the consuming public, thereby making such braking device for toilet tissue dispenser economically available to the buying public.

Still yet another object of the present invention is to provide a new braking device for toilet tissue dispenser which provides in the apparatuses and methods of the prior art some of the advantages thereof, while simultaneously overcoming some of the disadvantages normally associated therewith.

Still another object of the present invention is to provide a new braking device for toilet tissue dispenser for reducing the amount of tissue used.

Yet another object of the present invention is to provide a new braking device for toilet tissue dispenser which includes a spring biased ring member mounted around the spindle and between the end of the roll and one of the support arms for producing a pressure on the end of the roll and reducing the ease with which it can dispense tissue.

Still yet another object of the present invention is to provide a new Apparatus For Saving Toilet Tissue that saves money by reducing the amount of tissue used.

Even still another object of the present invention is to provide a new braking device for toilet tissue dispenser that prevents casual unraveling of tissue from the roll, eliminating the frustration of rewinding the unraveled tissue.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded view of the pressure ring.

FIG. 6 is a cross sectional view taken along line 6—6 of FIG. 3.

DESCRIPTION OF THE PREFERRED EMBODIMENT

Figure 2:
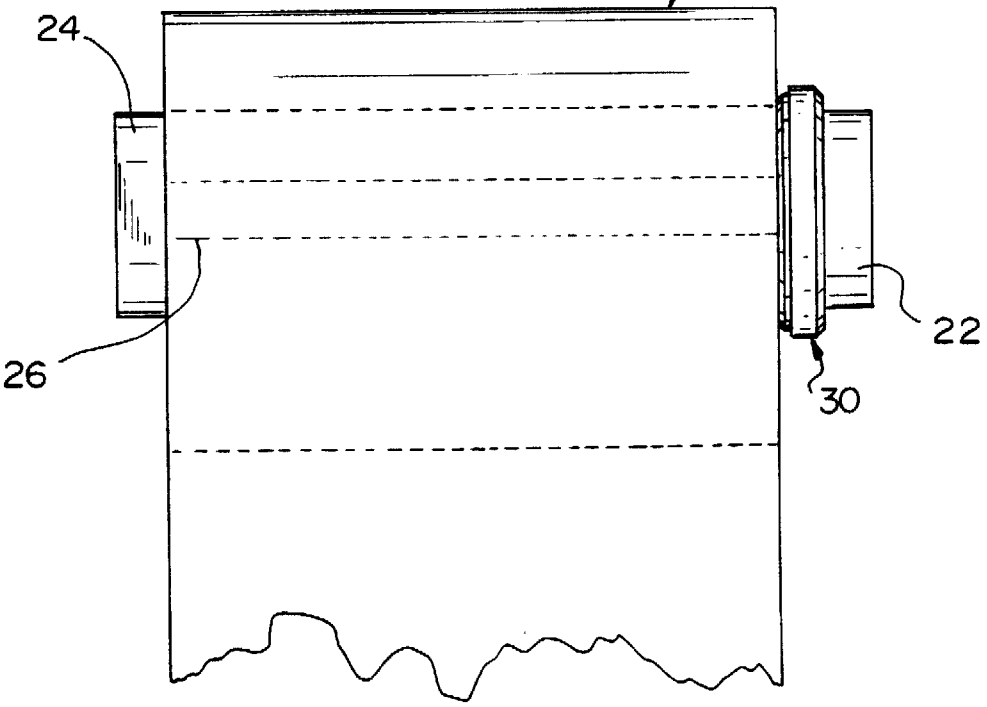
FIG. 2 is a front view thereof.
Figure 1:
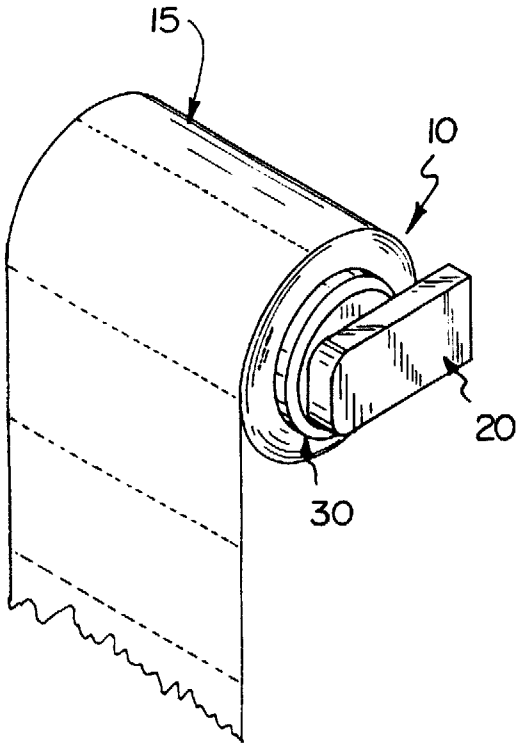
FIG. 1 is a right side perspective view of a new braking device for toilet tissue dispenser mounted on a conventional holder according to the present invention.
Figure 3:
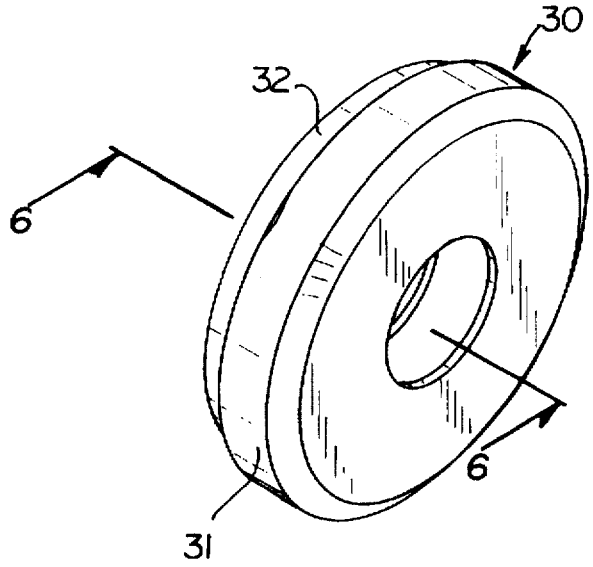
FIG. 3 is a rear isometric illustration of the pressure ring.
Figure 4:
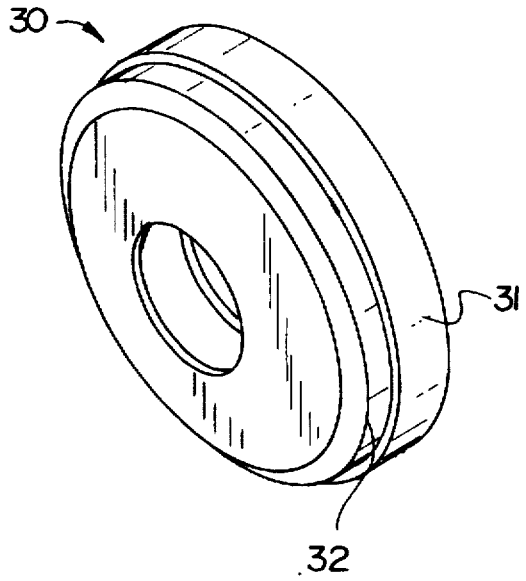
FIG. 4 is a front isometric view of the pressure ring.

With reference now to the drawings, and in particular to FIGS. 1 through 6 thereof, a new braking device for toilet tissue dispenser embodying the principles and concepts of the present invention and generally designated by the reference numeral 10 will be described.

More specifically, it will be noted that the braking device for toilet tissue dispenser 10 comprises a conventional tissue roll holder 20 holding a roll of tissue 15, and pressure ring means 30 for producing a pressure on the end of the roll.

As best illustrated in FIGS. 1 through 6, it can be shown that the tissue roll holder 20 is of conventional design including support arms 22,24 and a spindle 26, shown in dashed lines, extending between the support arms. The arms 22,24 are secured to a support wall in any appropriate fashion. The roll of tissue paper 15 is rotationally supported upon the spindle 26 for free rotation about the spindle. The roll 15 also fits between the arms 22,24.

Disposed between the end of the roll 15 and the support arm 22 is the pressure ring means 30. The ring 30 includes a first cup shaped disc 31 and a second cup shaped disc 32 secured together and spring biased apart.

The first disc 31 includes an end wall 33 having an aperture 34 allowing passage of the spindle 26, a side wall 35 secured to the end wall 33 and defining a diameter for the disc 31, and a shoulder 36 extending inward from an end of the side wall 35 parallel to the end wall 33.

The second disc 32 also includes an end wall 37 with an aperture 38 allowing passage of the spindle 26, side wall 39 secured to the end wall 37 and defining a diameter for the disc 32, and a shoulder 40 extending upward from an end of the side wall 39 and parallel to the end wall 37. However, the diameter of the disc 32 is less than the diameter of the disc 31 such that the disc 32 fits within the disc 31. The shoulder 40 is disposed behind the shoulder 36 so as to secure the two discs together.

When secured together, the two discs define a chamber 42 for holding a spring 44. The spring 44 is a coil spring having one end engaging the end wall 33 and the other end engaging the end wall 37 so as to bias the end walls 33,37 away from each other until the shoulders 36,40 are in engagement. Note that the spacing between the end of the roll 15 and the arm 22 should be less than the maximum spacing between the end walls 33,37 when the shoulders 36,40 are engaged, in order to cause the discs to be moved relative to each other during installation such that the shoulders 36,40 are no longer engaged, thus ensuring a biasing force on the end of the roll.

In use, the pressure ring 30 is disposed between the end of the roll 15 and the arm 22. In the installed position, the disc 32 is moved to the right in FIG. 6 moving the shoulders 36,40 out of engagement. In this position, the spring 44 causes a biasing force to the left in FIG. 6, forcing the disc 32 against the side of the roll. This force reduces the ease with which the roll can rotate about the spindle, by causing friction between the end of the roll and the disc 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An accessory for a toilet tissue roll holder of the conventional type having two support arms for mounting in a spaced and substantially parallel relationship, each support arm having a support recess thereon for orienting in an opposed relationship to the recess in the other said support arm, said roll holder additionally including a collapsible removable spindle extending between the support arms and engaging the recess in each said support arm, said spindle being for having a roll of toilet tissue disposed thereabout, said accessory comprising:

a pressure ring means for exerting pressure on the end of a toilet tissue roll to provide increased resistance to rotation of said toilet tissue roll on said roll holder and thereby discourage excessive dispensing of toilet tissue therefrom;

wherein said pressure ring means comprises first and second discs, one said disc being for positioning adjacent to and pressing against a support arm of said toilet tissue roll holder and the other said disc being for positioning adjacent to and pressing against the end of a toilet tissue roll mounted on said roll holder, and a spring positioned between said first and second discs for biasing said first and second discs apart against said support arm and said toilet tissue roll to thereby press said tissue roll against the other support arm of said roll holder;

said first and second discs each having an aperture therein positioned in substantial alignment with the aperture in the other said disc, the aperture in each said disc being of a size sufficiently large so as to minimize contact between said discs and said spindle and thereby permit free rotation of said discs relative to said spindle and permit free expansion movement of said discs with respect to each other, whereby said pressure ring means is easily mountable on and removable from a portion of the spindle of a conventional tissue roll holder in a position between the end of a toilet tissue roll and a support arm of said roll holder without requiring modification of said roll holder.

2. The accessory of claim 1, wherein said first disc comprises a first end wall and a first perimeter wall extending substantially perpendicularly to said first end wall, and a first shoulder wall extending from said first perimeter wall extending substantially parallel to said first end wall, wherein said second disc comprises a second end wall and a second perimeter wall extending substantially perpendicularly to said second end wall, and a second shoulder wall extending from said second perimeter wall extending substantially parallel to said second end wall; wherein the first disc and second disc are secured to each other by the first and second shoulders, such that a chamber is defined between the end walls and side walls of the discs, said spring being disposed within said chamber.

3. A toilet tissue roll holder system comprising:

a toilet tissue roll holder having two support arms in a spaced and substantially parallel relationship, each support arm having a support recess thereon for orienting in an opposed relationship to the recess in the other said support arm, said roll holder additionally including a collapsible removable spindle extending between the support arms and engaging the recess in each said support arm, said spindle having a roll of toilet tissue disposed thereabout for freely rotating about said spindle; and a roll holder accessory including a pressure ring means for exerting pressure on the end of a toilet tissue roll to provide increased resistance to rotation of said toilet tissue roll on said roll holder and thereby discourage excessive dispensing of toilet tissue therefrom;

said pressure ring means comprising first and second discs, one said disc being for positioning adjacent to and pressing against a support arm of said toilet tissue roll holder and the other said disc being for positioning adjacent to and pressing against the end of a toilet tissue roll mounted on said roll holder, and a spring positioned between said first and second discs for biasing said first and second discs apart against said support arm and said toilet tissue roll to thereby press said tissue roll against the other support arm of said roll holder;

said first and second discs each having an aperture therein positioned in substantial alignment with the aperture in the other said disc, the aperture in each said disc being of a size sufficiently large so as to minimize contact between said discs and said spindle and thereby permit free rotation of said discs relative to said spindle and permit free expansion movement of said discs with respect to each other, whereby said pressure ring means is easily mountable on and removable from a portion of the spindle of a conventional tissue roll holder in a position between the end of a toilet tissue roll and a support arm of said roll holder without requiring modification of said roll holder.

* * * * *